US009104137B2

(12) United States Patent
Murata et al.

(10) Patent No.: US 9,104,137 B2
(45) Date of Patent: Aug. 11, 2015

(54) TONER CONVEYING DEVICE, IMAGE FORMING APPARATUS, AND TONER CASE

(71) Applicant: KYOCERA DOCUMENT SOLUTIONS INC., Osaka-shi, Osaka (JP)

(72) Inventors: Koji Murata, Osaka (JP); Takehiro Sato, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/170,329

(22) Filed: Jan. 31, 2014

(65) Prior Publication Data

US 2014/0219688 A1 Aug. 7, 2014

(30) Foreign Application Priority Data

Feb. 1, 2013 (JP) ..... 2013-018042

(51) Int. Cl.
*G03G 15/08* (2006.01)

(52) U.S. Cl.
CPC .... *G03G 15/0877* (2013.01); *G03G 2215/0827* (2013.01)

(58) Field of Classification Search
CPC ..... G03G 15/0832; G03G 15/0834; G03G 15/0839
USPC ..... 399/261, 263
See application file for complete search history.

(56) References Cited

U.S. PATENT DOCUMENTS 5,113,227 A * 5/1992 Miyasaka ..... 399/358
6,405,010 B2 6/2002 Ashikari et al.

FOREIGN PATENT DOCUMENTS

JP 2001-337523 A 12/2001
JP 2006259273 A * 9/2006
JP 2008-216360 A 9/2008

OTHER PUBLICATIONS

Machine Translation of JP 2006-259273 A obtained on Nov. 20, 2014.*

* cited by examiner

*Primary Examiner* — Gregory H Curran
(74) *Attorney, Agent, or Firm* — Studebaker & Brackett PC

(57) ABSTRACT

A toner conveying device includes a toner containing part, a conveying member, and a vibration mechanism. The toner containing part contains a toner. The conveying member rotates around a rotation axis so as to convey the toner in the toner containing part. The vibration mechanism vibrates the conveying member in directions of the rotation axis.

15 Claims, 7 Drawing Sheets

10
9
11
21
22
23
24
25
26
27
28
30
31
32
33
34
35
36
37
38
40
41
42
43
44
45
46
50
51
52
53
54
B
C
D
E
H

TONER CONVEYING DEVICE, IMAGE FORMING APPARATUS, AND TONER CASE

INCORPORATION BY REFERENCE

This application is based on and claims the benefit of priority from Japanese Patent application No. 2013-018042 filed on Feb. 1, 2013, the entire contents of which are incorporated herein by reference.

BACKGROUND

The present disclosure relates to a toner conveying device to convey a toner (developer), an image forming apparatus including the toner conveying device, and a toner case installed in the toner conveying device.

Electrophotographic image forming apparatus includes a toner conveying device for the purpose of supplying the toner to the surface of an image carrier (such as a photosensitive drum) and collecting the toner (hereinafter referred to as "waste toner") remaining on the surface of the image carrier. For example, the toner conveying device includes a toner containing part configured to contain the toner and a conveying member configured to rotate around a rotation axis so as to convey the toner in the toner containing part. For example, the conveying member includes a screw shaft extending in directions of the rotation axis and a spiral fin installed around the screw shaft. The fin presses the toner accompanying to a rotation of the conveying member, thereby moving the toner.

In the toner conveying device configured as described above, the toner that has been charged may attach to the conveying member. As a result, a toner conveying space in the toner containing part may be reduced, thereby hindering toner conveying performance. Such a phenomenon is particularly conspicuous when the conveying member is made of a resin and more likely to occur when the toner with poor fluidity, such as the waste toner, is used.

In order to reduce attachment of toner to the conveying member as described above, there is a configuration that a portion of an agitating paddle is brought into contact with the conveying member, thereby supplying vibration to the conveying member. There is also a configuration that a twisted coil spring for vibration is attached to the conveying member. There is also a configuration that a projection provided at the toner containing part or an elastic member made of a film is brought into contact with the conveying member.

However, when the vibration is supplied to the conveying member in the configurations described above, force is applied to the conveying member in a direction (radial direction) perpendicular to the directions of the rotation axis. For that reason, the conveying member may be elastically deformed and then may be deflected, so that a portion of the conveying member may come into contact with the toner containing part, thereby causing noise. Further, when adopting the configuration in which the projection or the elastic member is brought into contact with the conveying member, noise may be caused at pitches corresponding to the number of the rotations of the conveying member rotating at high speed.

SUMMARY

In accordance with an embodiment of the present disclosure, A toner conveying device includes a toner containing part, a conveying member, and a vibration mechanism. The toner containing part contains a toner. The conveying member rotates around a rotation axis so as to convey the toner in the toner containing part. The vibration mechanism vibrates the conveying member in directions of the rotation axis.

In accordance with an embodiment of the present disclosure, an image forming apparatus includes a toner conveying device. The toner conveying device includes a toner containing part, a conveying member, and a vibration mechanism. The toner containing part contains a toner. The conveying member rotates around a rotation axis so as to convey the toner in the toner containing part. The vibration mechanism vibrates the conveying member in directions of the rotation axis.

In accordance with an embodiment of the present disclosure, a toner case includes a toner containing part and a conveying member. The toner containing part contains a toner. The conveying member rotates around a rotation axis so as to convey the toner in the toner containing part. The conveying member is vibrated by a vibration mechanism in directions of the rotation axis.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
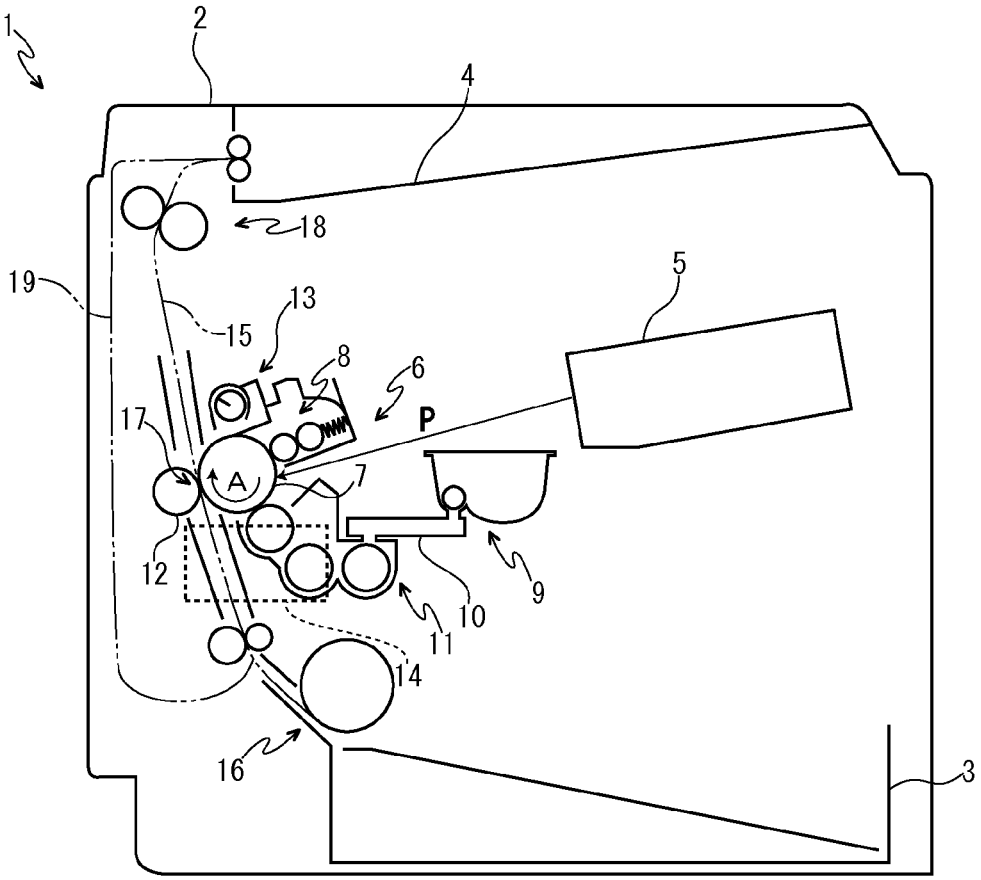
FIG. 1 is a schematic diagram schematically showing a monochrome printer according to a first embodiment of the present disclosure.

First, with reference to FIG. 1, the whole structure of a monochrome printer 1 (an image forming apparatus) will be described. FIG. 1 is a schematic diagram schematically showing a monochrome printer according to a first embodiment of the present disclosure. Hereinafter, it will be described so that the front side of the monochrome printer 1 is positioned at this side (a reader's side) of FIG. 1.

The monochrome printer 1 includes a box-shaped printer main body 2. In a lower part of the printer main body 2, a sheet feeding cartridge 3 storing sheets (not shown) is installed and, in a top end of the printer main body 2, a sheet ejecting tray 4 is formed.

In an upper right part of the printer main body 2, an exposure device 5 composed of a laser scanning unit (LSU) is installed and, in a left part of the printer main body 2, an image forming part 6 is arranged. In the image forming part 6, a photosensitive drum 7 as an image carrier is rotatably installed. Around the photosensitive drum 7, a charger 8, a development device 11 connected to a toner container 9 via a toner conveying device 10, a transferring roller 12, a cleaning device 13 are located along a rotating direction (refer to an arrow A in FIG. 1) of the photosensitive drum 7. In the toner container 9, a developer is contained. For example, the developer is a one-component developer composed of a toner or a two-component developer composed of the toner and a carrier. Hereinafter, the developer is simply called as "the toner". Under the cleaning device 13, a toner collecting box 14 is arranged.

In the left part of the printer main body 2, a sheet conveying path 15 is arranged from a lower side to an upper side. At an upstream end in the conveying path 15, a sheet feeder 16 is positioned. At an intermediate stream part in the conveying path 15, a transferring unit 17 composed of the photosensitive drum 7 and transferring roller 12 is positioned. At a downstream part in the conveying path 15, a fixing device 18 is positioned. In the left side of the conveying path 15, an inversion path 19 for duplex printing is arranged.

Next, the operation of forming an image by the monochrome printer 1 having such a configuration will be described.

When the power is supplied to the monochrome printer 1, various parameters are initialized and initial determination, such as temperature determination of the fixing device 18, is carried out. Subsequently, in the monochrome printer 1, when image data is inputted and a printing start is directed from a computer or the like connected with the monochrome printer 1, image forming operation is carried out as follows.

First, the surface of the photosensitive drum 7 is uniformly electric-charged by the charger 8. Then, exposure corresponding to the image data on the photosensitive drum 7 is carried out by a laser light (refer to an arrow P in FIG. 1) from the exposure device 5, thereby forming an electrostatic latent image on the surface of the photosensitive drum 7. Subsequently, the development device 11 develops the electrostatic latent image by the toner supplied from the toner container 9 via the toner conveying device 10. Accordingly, a toner image is carried on the photosensitive drum 7.

On the other hand, the sheet fed from the sheet feeding cartridge 3 by the sheet feeder 16 is conveyed to the transferring unit 17 in a suitable timing for the above-mentioned image forming operation. Then, the toner image carried on the photosensitive drum 7 is transferred onto the sheet by the transferring roller 12. The sheet with the transferred toner image is conveyed to a downstream side in the conveying path 15 to go forward to the fixing device 18, and then, the toner image is fixed on the sheet in the fixing device 18. The sheet with the fixed toner image is ejected from a downstream end in the conveying path 15 to the sheet ejecting tray 4. The toner remained on the photosensitive drum 7 is removed by the cleaning device 13 and conveyed to the toner collecting box 14.

Next, the toner conveying device 10 will be described in detail, with reference to FIGS. 2-4.

Figures 2A, 2B:
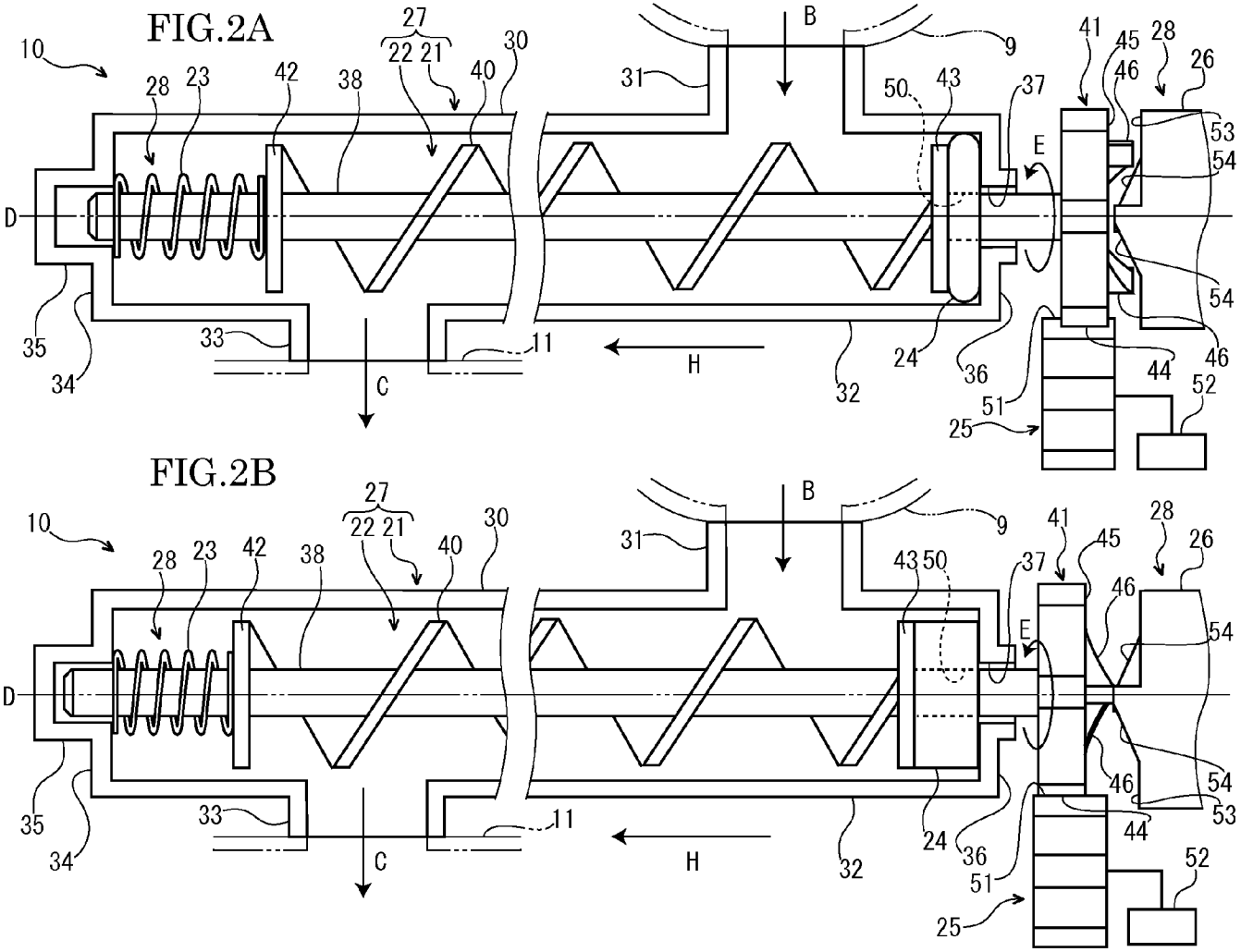
FIG. 2A is a front view showing a state in which a conveying screw is in a pressure released position in a toner conveying device of the monochrome printer according to the first embodiment of the present disclosure.
FIG. 2B is a front view when the conveying screw is in a pressed position in the toner conveying device of the monochrome printer according to the first embodiment of the present disclosure.

As shown in FIGS. 2A and 2B, the toner conveying device 10 includes a box-shaped toner containing part 21, a conveying screw (conveying member) 22 installed in the toner containing part 21, a coil spring (biasing member) 23 held at a left end portion of the toner containing part 21, a sealing member 24 held at a right end portion of the toner containing part 21, a driving piece 25 provided below a right end portion of the conveying screw 22, and a pressing member 26 provided on the right side of the right end portion of the conveying screw 22 on the page of FIGS. 2A and 2B.

The toner containing part 21 and the conveying screw 22 constitute a conveying case (toner case) 27. In other words, the conveying case 27 includes the toner containing part 21 and the conveying screw 22. The coil spring 23 and the pressing member 26 constitute a vibration mechanism 28. In other words, the vibration mechanism 28 includes the coil spring 23 and the pressing member 26.

First, the toner containing part 21 will be described. The toner containing part 21 is formed in an elongated-shape in left and right directions. The toner containing part 21 contains the toner. A toner inlet port 31 is provided in a right-side portion of an upper wall 30 of the toner containing part 21. The toner inlet port 31 is connected to the toner container 9, thereby introducing the toner discharged from the toner container 9 into the toner containing part 21 through the toner inlet port 31 (refer to an arrow B in each of FIGS. 2A and 2B). A toner outlet port 33 is provided in a left-side portion of a lower wall 32 of the toner containing part 21. The toner outlet port 33 is connected to the development device 11, thereby introducing the toner discharged from the toner containing part 21 into the development device 11 through the toner outlet port 33 (refer to an arrow C in each of FIGS. 2A and 2B). A bearing part 35 is protruded at the center of a left end wall 34 of the toner containing part 21 to the left direction. A penetrated hole 37 is formed in the left and right directions in the center of a right side wall 36 of the toner containing part 21.

Next, the conveying screw 22 will be described. The conveying screw 22 is formed in an elongated-shape in left and right directions. The conveying screw 22 includes a screw shaft 38 extending in the left and right directions, a spiral fin 40 installed around the screw shaft 38, and a pressed piece 41 fixed to a right end portion of the screw shaft 38.

A portion from a left end to a right side of the screw shaft 38 of the conveying screw 22 is held in the toner containing part 21. The left end portion of the screw shaft 38 is inserted into the bearing part 35 provided at the left end wall 34 of the toner containing part 21, and the right side portion of the screw shaft 38 passes through the penetrated hole 37 provided in the right end wall 36 of the toner containing part 21. With this arrangement, the conveying screw 22 is supported by the toner containing part 21 so that the conveying screw 22 may be rotated around a rotation axis D in the left and right directions. That is, the left and right directions are directions of the rotation axis D of the conveying screw 22, in this embodiment. An arrow E in each of FIGS. 2 to 4 indicates a rotation direction of the conveying screw 22. The right end portion of the screw shaft 38 is exposed to an outside of the toner containing part 21.

The fin 40 of the conveying screw 22 is held in the toner containing part 21. A first flange plate 42 is provided at a left end portion of the fin 40. The first flange plate 42 is provided generally perpendicular to the directions of the rotation axis D, and faces to the left-end wall 34 of the toner containing part 21 at a predetermined interval. A second flange plate 43 is provided at a right end portion of the fin 40. The second flange plate 43 is provided generally perpendicular to the directions of the rotation axis D, and faces to the right end wall 36 of the toner containing part 21 at a predetermined interval.

Figure 3A:
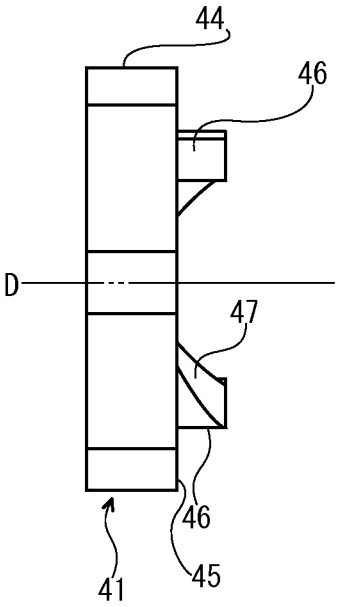
FIG. 3A is a front view showing a pressed piece in the toner conveying device of the monochrome printer according to the first embodiment of the present disclosure.
Figure 3B:
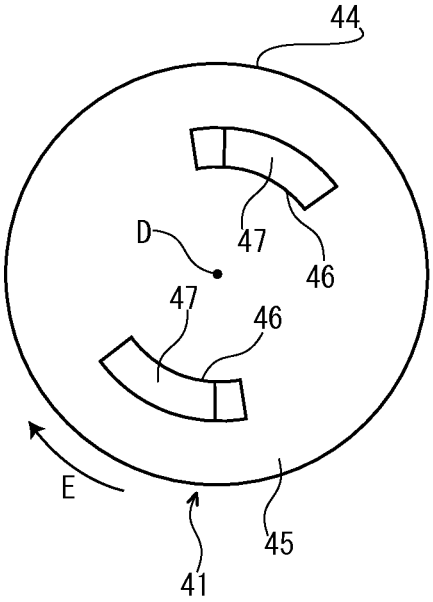
FIG. 3B is a right side view of the pressed piece in the toner conveying device of the monochrome printer according to the first embodiment of the present disclosure.

The pressed piece 41 of the conveying screw 22 is arranged outside the toner containing part 21, and is provided generally perpendicular to the directions of the rotation axis D. A driven gear 44 is provided on an outer periphery of the pressed piece 41. As shown in FIGS. 3A and 3B, pressed projections 46 are provided on a right side surface 45 (a surface in one side of the directions of the rotation axis D) of the pressed piece 41. Two pressed projections 46 are provided at intervals of an equal angle (intervals of 180 degrees), and are arranged at diagonal positions around the rotation axis D. Each pressed projection 46 is curved along a circumference centering on the rotation axis D. Each pressed projection 46 includes a pressed guide surface 47 at its portion on a lower stream side in a rotation direction E. The pressed guide surface 47 is inclined rightward (a direction projecting from the right side surface 45 of the pressed piece 41) toward an upper stream side in the rotation direction E.

Next, the coil spring 23 will be described. As shown in FIGS. 2A and 2B, the coil spring 23 is wound around a left end side portion of the screw shaft 38 of the conveying screw 22. The coil spring 23 is inserted between the left end wall 34 of the toner containing part 21 and the first flange plate 42 of the conveying screw 22, and biases the conveying screw 22 to a right side (the one side of the directions of the rotation axis D).

Next, the sealing member 24 will be described. The sealing member 24 is formed in a ring-like shape. An insertion hole 50 is provided in the left and right directions of the sealing member 24. The screw shaft 38 of the conveying screw 22 is inserted into the insertion hole 50. The sealing member 24 is interposed between the right end wall 36 of the toner containing part 21 and the second flange plate 43 of the conveying screw 22. The sealing member 24 is in contact with the right end wall 36 of the toner containing part 21, thereby ensuring sealing of the toner containing part 21 around the penetrated hole 37.

The sealing member 24 is made of a material with elasticity and a sealing property, such as a sponge, rubber, an air cushion, a felt or the like. The sealing member 24 is provided to be compressible in the left and right directions. force with which the sealing member 24 in a compressed state (refer to FIG. 2A) presses the conveying screw 22 to a left side by its elastic restoring force is set to be smaller than a force with which the coil spring 23 presses the conveying screw 22 to the right side. The sealing member 24 has a rectangular (oblong) section in an uncompressed state (refer to FIG. 2B).

Next, the driving piece 25 will be described. A driving gear 51 is provided on an outer periphery of the driving piece 25. The driving gear 51 meshes with the driven gear 44 provided at the pressed piece 41 of the conveying screw 22. Thus, accompanying to the rotation of the driving piece 25, the conveying screw 22 rotates. The driving piece 25 is connected to a drive source 52 composed of a motor or the like so as to rotate the driving piece 25 by the drive source 52. The drive source 52 is schematically shown in FIGS. 2A and 2B. An actual position of the drive source 52 therefore does not necessarily coincide with the position of the drive source 52 shown in each of FIGS. 2A and 2B.

Figure 4A:
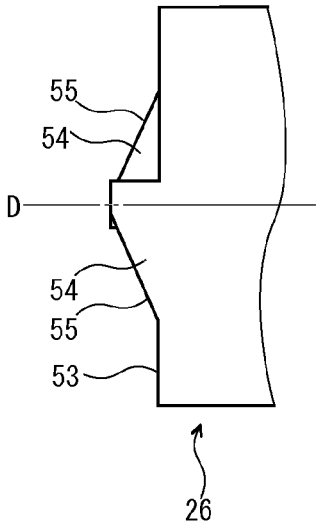
FIG. 4A is a front view showing a pressing member in the toner conveying device of the monochrome printer according to the first embodiment of the present disclosure.
Figure 4B:
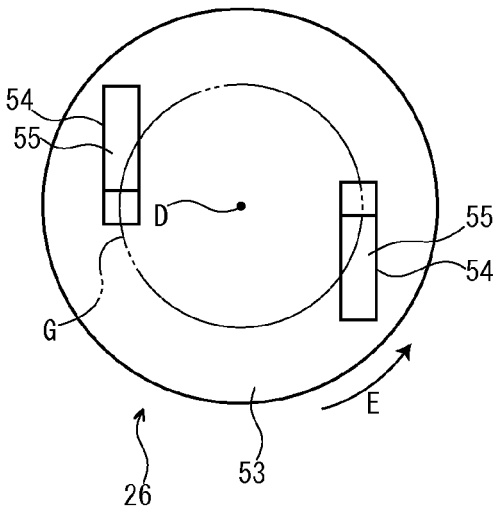
FIG. 4B is a left side view of the pressing member in the toner conveying device of the monochrome printer according to the first embodiment of the present disclosure.

Next, the pressing member 26 will be described. The pressing member 26 is arranged outside the toner containing part 21, and is fixed to the frame of the printer main body 2 (refer to FIG. 1), for example. As shown in FIGS. 4A and 4B, pressing projections 54 are provided on a left side surface 53 (a surface in another side of the directions of the rotation axis D) of the pressing member 26. Two pressing projections 54 are provided at intervals of an equal angle (intervals of 180 degrees), and are arranged at diagonal positions around the rotation axis D. Each pressing projection 54 has a shape of a straight line in a tangential direction of a circumference G centering on the rotation axis D. Each pressing projection 54 includes a pressing guide surface 55 at its portion on the upper stream side in the rotation direction E. The pressing guide surface 55 is inclined leftward (a direction projecting from the left side surface 53 of the pressing member 26) toward a lower stream side in the rotation direction E.

When the driving piece 25 is rotated by the drive source 52 in the toner conveying device 10 configured as described above, this rotation is transmitted to the conveying screw 22, and the conveying screw 22 rotates in the rotation direction E around the rotation axis D. Rotation of the conveying screw 22 in the rotation direction E in this manner causes the toner in the toner containing part 21 to be conveyed to the left side by the fin 40 of the conveying screw 22 (refer to an arrow H in each of FIGS. 2A and 2B). Then, the toner is discharged to the development device 11 through the toner outlet port 33 (refer to the arrow C in each of FIGS. 2A and 2B).

When the conveying screw 22 rotates as described above, the pressed projections 46 provided at the pressed piece 41 of the conveying screw 22 rotate relatively to the pressing projections 54 provided at the pressing member 26. When the conveying screw 22 is located at a certain position, a pressure on each pressed projection 46 of the conveying screw 22 by a corresponding one of the pressing projections 54 of the pressing member 26 is released, as shown in FIG. 2A. The position of the conveying screw 22 at this time is referred to as a "pressure released position". When the conveying screw 22 is in the pressure released position as described above, the conveying screw 22 is moved to the right side (in the one of the directions of the rotation axis D) by the biasing force of the coil spring 23, so that the sealing member 24 is compressed.

On contrast therewith, when the conveying screw 22 rotates from the pressure released position by 90 degrees, the pressing projections 54 of the pressing member 26 presses the pressed projections 46 of the conveying screw 22 to the left side (to the other of the directions of the rotation axis D) against the biasing force of the coil spring 23. The conveying screw 22 thereby moves to the left side. The position of the conveying screw 22 at this time is referred to as a "pressed position". When the conveying screw 22 is in the pressed position as described above, the sealing member 24 is not compressed.

On contrast therewith, when the conveying screw 22 further rotates by 90 degrees from the pressed position, the conveying screw 22 is restored to the pressure released position, as shown in FIG. 2A. With this restoration of the conveying screw 22 to the pressure released position, the conveying screw 22 moves to the right side (in the one of the directions of the rotation axis D) by the biasing force of the coil spring 23, so that the sealing member 24 is compressed.

Pressing and pressure release of the pressed projections 46 by the pressing projections 54 are repeated as described above. The conveying screw 22 thereby moves to the right side and left side repeatedly. Accompanying to these movements of the conveying screw 22, the conveying screw 22 vibrates in the left and right directions (in the directions of the rotation axis D).

The width in the left and right directions of the driving gear 51 of the driving piece 25 is set to be larger than a width obtained by adding the vibration amplitude in the left and right directions of the conveying screw 22 to the width in the left and right directions of the driven gear 44 of the conveying screw 22. Consequently, the mesh state between the driving gear 51 and the driven gear 44 is not released due to the vibration of the conveying screw 22 in the left and right directions.

In this embodiment, the conveying screw 22 is vibrated in the left and right directions (in the directions of the rotation axis D) by the vibration mechanism 28, as described above. Thus, attachment of the toner to the conveying screw 22 may be prevented. Consequently, a toner conveying space in the toner containing part 21 may be sufficiently secured, so that toner conveying performance may be enhanced. Force perpendicular to the directions of the rotation axis D is not applied to the conveying screw 22 when the conveying screw 22 is vibrated. Thus, the screw shaft 38 of the conveying screw 22 is not likely to be deflected. Consequently, contact of a deflected portion of the screw shaft 38 with the toner containing part 21 may be avoided. Occurrence of noise may be thereby prevented.

The coil spring 23 and the pressing member 26 constitute the vibration mechanism 28. With this arrangement, the conveying screw 22 may be vibrated in the directions of the rotation axis D by a simple structure.

Further, the pressing projections 54 press the pressed projections 46 to the left side (the other side of the directions of the rotation axis D) accompanying to the rotation of the conveying screw 22. Thus, the conveying screw 22 may be vibrated in the directions of the rotation axis D without moving the pressing member 26. For that reason, the need for a mechanism for moving the pressing member 26 is eliminated. Simplification of the structure may be thereby achieved.

The two pressing projections 54 are provided at intervals of the equal angle (intervals of 180 degrees). The two pressed projections 46 are provided at intervals of the equal angle (intervals of 180 degrees). Thus, Pressure force may be given to each pressed projection 46 from the corresponding one of the pressing projection 56 with a good balance.

Each pressing projection 54 includes the pressing guide surface 55 inclined in the direction projecting from the left side surface 53 of the pressing member 26 toward the lower stream side in the rotation direction E of the conveying screw 22. Consequently, each pressing projection 54 may be prevented from being caught by the pressed projection 46. The pressed projection 46 may be thereby surely pressured by the pressing projection 54. Further, each pressed projection 46 includes the pressed guide surface 47 inclined in the direction projecting from the right side surface 45 of the pressed piece 41 (surface in the one of the directions of the rotation axis D) toward the upper stream side in the rotation direction E of the conveying screw 22. Consequently, the pressing projection 54 may be further surely prevented from being caught by the pressed projection 46. The pressed projection 46 may be further surely pressured by the pressing projection 54.

Vibration of the conveying screw 22 may be prevented from being transmitted to the toner containing part 21 by the sealing member 24. Thus, occurrence of noise may be further surely prevented. In this embodiment in particular, the coil spring 23 is inserted between the left end wall 34 of the toner containing part 21 and the first flange plate 42 of the conveying screw 22 and the sealing member 24 is interposed between the right end wall 36 of the toner containing part 21 and the second flange plate 43 of the conveying screw 22. By adopting such a configuration, a magnitude of the vibration may be adjusted by changing a spring load of the coil spring 23 and hardness of the sealing member 24. Further, contact between the toner containing part 21 and the conveying screw 22 that are both rigid bodies may be avoided.

The conveying screw 22 including the screw shaft 38 in the left and right directions (in the directions of the rotation axis D) and the spiral fin 40 installed around the screw shaft 38 constitutes the conveying member. The toner may be therefore conveyed in the left and right directions (in the directions of the rotation axis D) by the conveying screw 22.

The first embodiment was described in a case of constituting the biasing member from the coil spring 23. In another different embodiment, however, the biasing member may be composed of a spring other than the coil spring 23, such as a plate spring. The biasing member may be composed of a member other than the spring, such as a foam sponge, rubber, or an air cushion.

The first embodiment was described in a case where the sealing member 24 had the rectangular (oblong) section in the non-compressed state. In another different embodiment, however, the sealing member 24 may have a precise circular section or an ellipsoid section that is elongated in the directions of the rotation axis D, in the non-compressed state.

The first embodiment was described in a case of providing the two pressing projections 54 at the intervals of 180 degrees, and providing the two pressed projections 46 at the intervals of 180 degrees. In another different embodiment, however, three or more pressing projections 54 may be provided at intervals of an equal angle, and three or more pressed projections 46 may be provided at intervals of an equal angle. In this case as well, a pressure force may be given to each pressed projection 46 from the pressing projection 54 with a good balance. In still another different embodiment, only one pressing projection 54 and only one pressed projection 46 may be provided.

The first embodiment was described in a case of applying the configuration of the present disclosure to the toner conveying device 10 configured to relay the toner container and the development device 11. In another different embodiment, on the other hand, the configuration of the present disclosure may be applied to a toner conveying device arranged at a location different from that in this embodiment, such as the toner conveying device configured to relay the cleaning device 13 and the toner collecting box 14.

The first embodiment was described in a case of applying the configuration of the present disclosure to the conveying case (toner case) 27. In another different embodiment, the configuration of the present disclosure may be applied to a toner case other than the conveying case 27, such as the toner container 9 or the toner collecting box 14.

The first embodiment was described in a case of applying the configuration of the present disclosure to the monochrome printer 1. In another different embodiment, the configuration of the present disclosure may also be applied to a different image forming apparatus such as a color printer, a copying machine, a facsimile, or a multifunction peripheral.

Second Embodiment

Next, a toner conveying device 61 according to a second embodiment of the present disclosure will be described, using FIGS. 5A and 5B. The configuration of the toner conveying device 61 other than a pressing member 62 is the same as that in the first embodiment excepting that no pressed projections 46 are provided at the pressed piece 41 of the conveying screw 22. Thus, same reference numerals are given to components that are the same as those in the first embodiment, and description of these components will be thereby omitted.

The pressing member 62 is connected to the drive source 52. The pressing member 62 is rotated around a pressing axis I by the drive source 52. The pressing axis I extends in a direction crossing the rotation axis D (direction orthogonal to the rotation axis D in this embodiment in particular). An arrow J in FIGS. 5A and 5B indicates the rotation direction of the pressing member 62.

A cam part 63 is provided at an outer peripheral portion of the pressing member 62. The cam part 63 includes one bend portion 66 that is bent toward an inner diameter side of the pressing member 62. A diameter d1 of a portion of the cam part 63 provided on an upper stream side than the bend portion 66 in a rotation direction J (hereinafter referred to as a "small diameter portion 64") is set to be smaller than a diameter d2 of a portion of the cam part 63 other than the small diameter portion 64 (hereinafter referred to as a "large diameter portion 65"). The large diameter portion 65 is a portion opposite to the small diameter portion 64, for example.

Figure 5A:
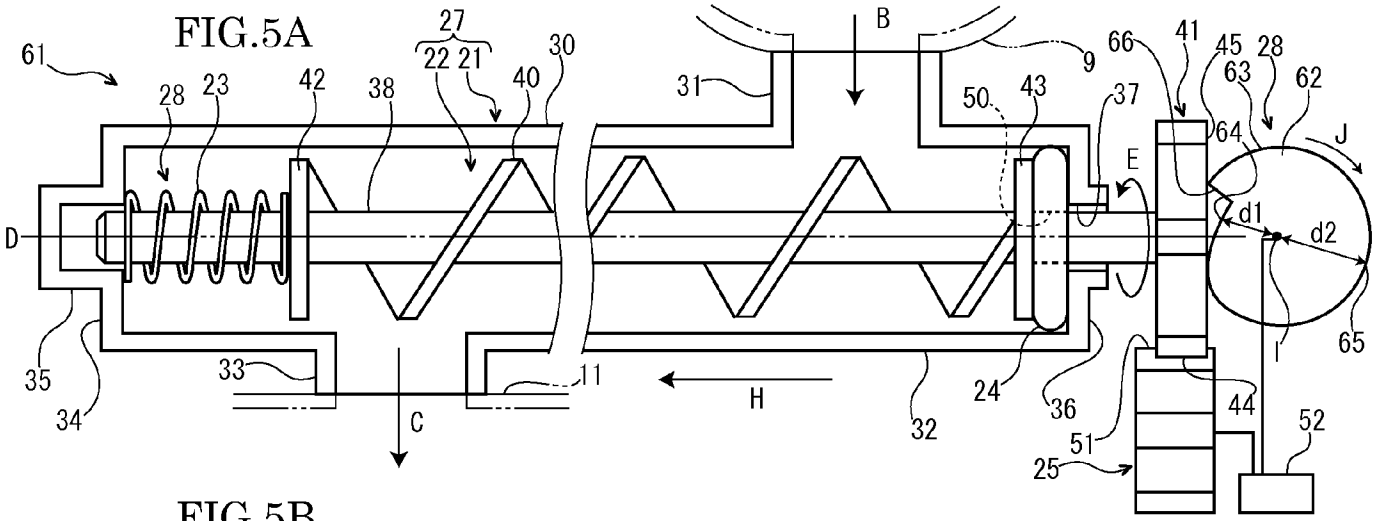
FIG. 5A is a front view showing a state in which a pressing member is in a pressure released position in a toner conveying device of a monochrome printer according to a second embodiment of the present disclosure.

When the pressing member 62 is located at a certain position in the configuration of the toner conveying device 61 as described above, the small diameter portion 64 of the cam part 63 of the pressing member 62 faces to the right side surface 45 of the pressed piece 41 of the conveying screw 22, as shown in FIG. 5A. The position of the pressing member 62 at this time is referred to as a "pressure released position". When the pressing member 62 is in the pressure released position as described above, the conveying screw 22 moves to a right side (the one side in the directions of the rotation axis D) by the biasing force of the coil spring 23.

Figure 5B:
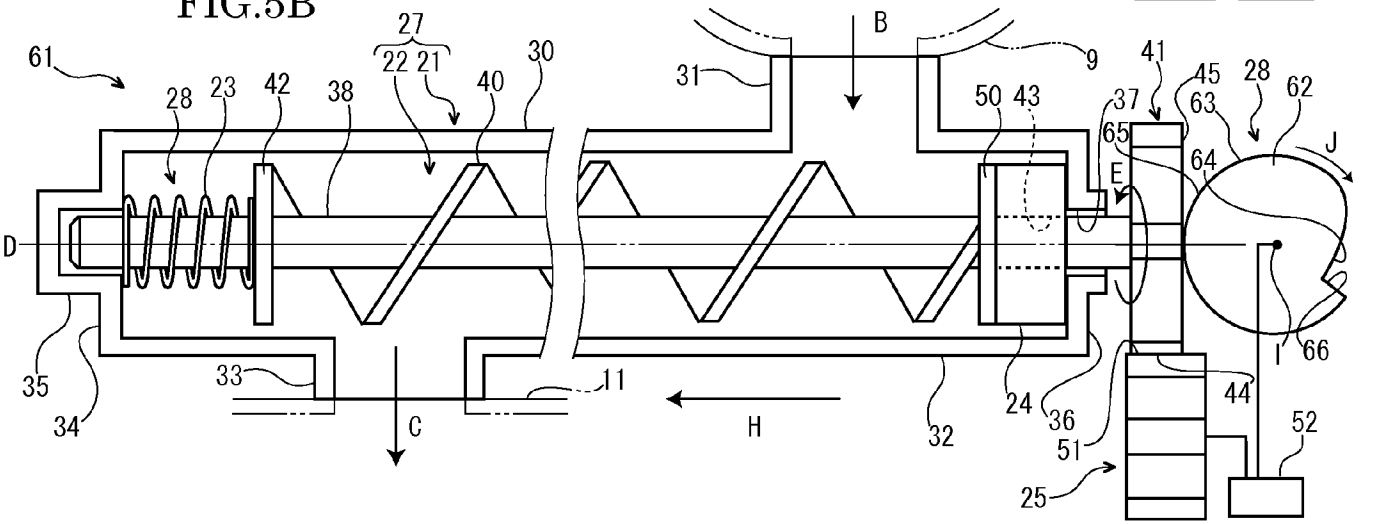
FIG. 5B is a front view showing a state in which the pressing member is in a pressing position in the toner conveying device of the monochrome printer according to the second embodiment of the present disclosure.

On contrast therewith, when the pressing member 62 rotates from the pressure released position by 180 degrees, the large diameter portion 65 of the cam part 63 of the pressing member 62 faces to the right side surface 45 of the pressed piece 41 of the conveying screw 22, as shown in FIG. 5B. Accompanying to this rotation, the cam part 63 of the pressing member 62 presses the pressed piece 41 of the conveying screw 22 to a left side (the other side of the directions of the rotation axis D) against the biasing force of the coil spring 23. Then, the conveying screw 22 moves to a left side (the other side of the directions of the rotation axis D). The position of the pressing member 62 at this time is referred to as a "pressing position".

On contrast therewith, when the pressing member 62 further rotates by 180 degrees from the pressing position, the pressing member 62 is restored to the pressure released position, as shown in FIG. 5A. Accompanying to this restoration of the pressing member 62 to the pressure released position, the conveying screw 22 moves to the right side (the one side of the directions of the rotation axis D) by the biasing force of the coil spring 23.

Pressing and pressure release of the conveying screw 22 by the cam part 63 of the pressing member 62 are repeated as described above. The conveying screw 22 thereby moves to the right side and the left side repeatedly. Accompanying to these movements of the conveying screw 22, the conveying screw 22 vibrates in left and right directions (in the directions of the rotation axis D). By adopting such a configuration, the conveying screw 22 may be vibrated in the directions of the rotation axis D without complicating the structure of the conveying screw 22.

In this embodiment, the bend portion 66 is provided at the cam part 63. Thus, the conveying screw 22 may be vibrated in the directions of the rotation axis D more rapidly than in a case where the cam part 63 is set to have a smooth shape. Consequently, attachment of toner to the conveying screw 22 may be further surely prevented.

The second embodiment was described in a case of providing one bend portion 66 at the cam part 63. In another different embodiment, however, a plurality of the bend portions 66 may be provided at the cam part 63. In this case, the cam part 63 may be stepwise formed by providing the plurality of the bend portions 66 at equal intervals in a peripheral direction of the cam part 63. Further, in still another different embodiment, the cam part 66 may be formed in a smooth shape without providing the bend portion 66 at the cam part 63

The second embodiment was described in a case of vibrating the conveying screw 22 in the left and right directions (in the directions of the rotation axis D), using a cam mechanism (refer to the cam part 63). In another different embodiment, however, the conveying screw 22 may be vibrated in the left and right directions (in the directions of the rotation axis D), using a configuration other than the cam mechanism, such as a ratchet mechanism.

Third Embodiment

Figure 6:
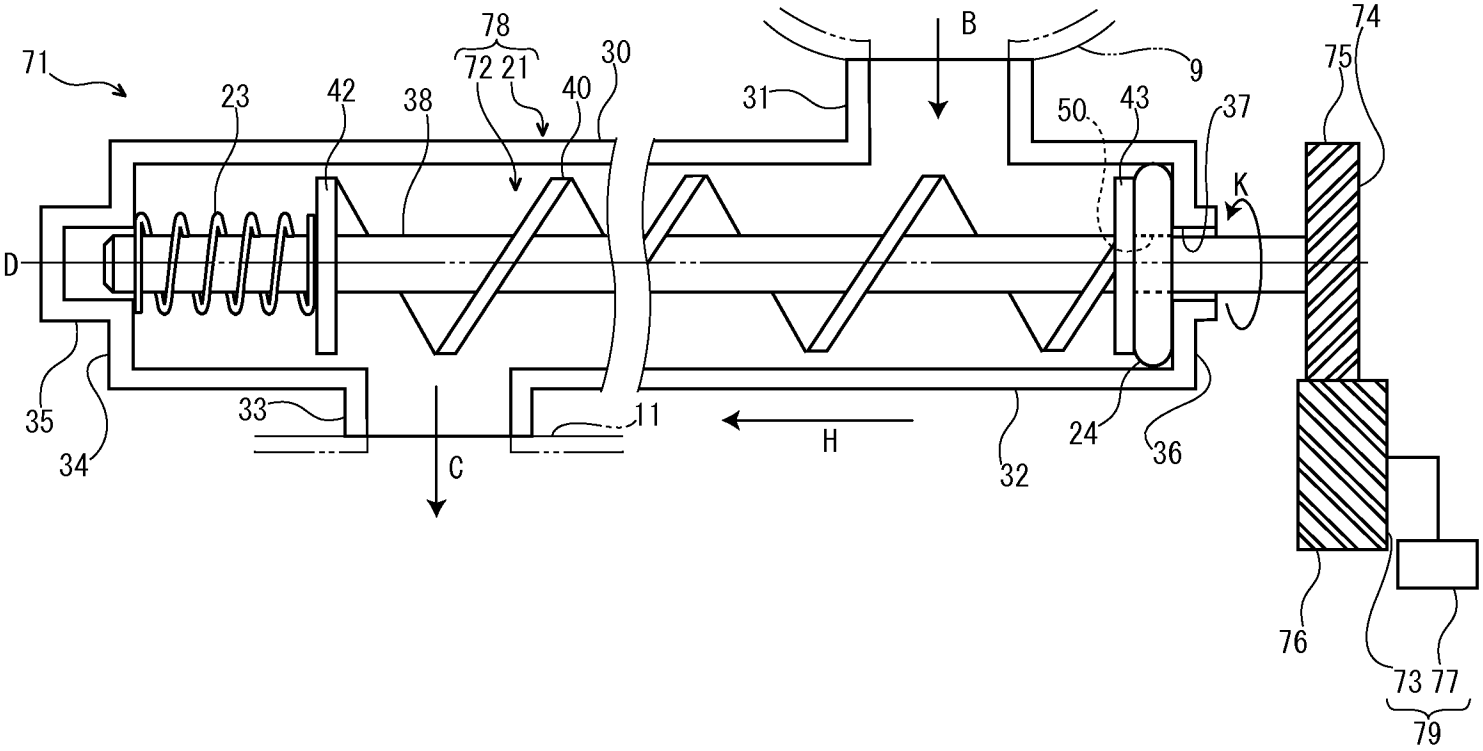
FIG. 6 is a front view showing a toner conveying device of a monochrome printer according to a third embodiment of the present disclosure.

Next, a toner conveying device 71 according to a third embodiment of the present disclosure will be described, using FIGS. 6 and 7. The configuration of the toner conveying device 71 according to the third embodiment of the present disclosure other than a conveying screw 72 (conveying member) and a driving piece 73 is the same as that in the first embodiment. Thus, same reference numerals are given to components that are the same as those in the first embodiment, and description of these components will be thereby omitted.

The conveying screw 72 together with the toner containing part 21 constitute a conveying case (toner case) 78. In other words, the conveying case 78 includes the toner containing part 21 and the conveying screw 72. As shown in FIG. 6, the conveying screw 72 includes the screw shaft 38 in left and right directions, the spiral fin 40 installed around the screw shaft 38, and a driven piece 74 fixed to a right end portion of the screw shaft 38. The screw shaft 38 and the fin 40 each have the same configuration as that in the first embodiment. Thus, same reference numerals as those in the first embodiment are given to the screw shaft 38 and the fin 40 in FIG. 6, thereby description of the screw shaft 38 and the fin 40 will be omitted.

The driven piece 74 of the conveying screw 72 is provided generally perpendicular to the directions of the rotation axis D. A driven gear 75 is provided on an outer periphery of the driven piece 74. The driven gear 75 is a helical gear.

A driving gear 76 is provided on an outer periphery of the driving piece 73. The driving gear 76 meshes with the driven gear 75 of the driven piece 74. With this arrangement, the conveying screw 72 rotates together with rotation of the driving piece 73. The driving gear 76 is a helical gear.

The driving piece 73 is connected to a vibration source 77 formed of a motor or the like capable of rotating normally or reversely. The driving piece 73 is rotated normally or reversely by the vibration source 77. The vibration source 77 together with the driving piece 73, constitute a vibration mechanism 79. In other words, the vibration mechanism 79 includes the driving piece 73 and the vibration source 77. The vibration source 77 is schematically shown in FIG. 6, and an actual position of the vibration source 77 does not necessarily coincide with the position of the vibration source 77 shown in FIG. 6.

When the driving piece 73 is normally and continuously rotated in the toner conveying device 71 as described above, this rotation is transmitted to the conveying screw 72, so that the conveying screw 72 rotates in a rotation direction K. When the conveying screw 72 rotates in the rotation direction K as described above, the toner in the toner containing part 21 is conveyed to a left side by the fin 40 of the conveying screw 72 (refer to an arrow H in FIG. 6), and is discharged to the development device 11 through the toner outlet port 33 (refer to an arrow C in FIG. 6).

Figure 7A:
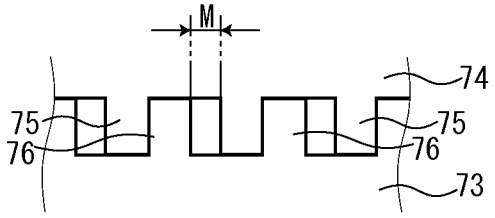
FIG. 7A is an explanatory view showing a mesh portion between a driving gear and a driven gear when a driving piece is normally rotated in the toner conveying device of the monochrome printer according to the third embodiment of the present disclosure.
Figure 7B:
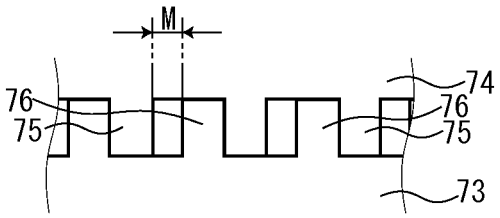
FIG. 7B is an explanatory view showing a mesh portion between the driving gear and the driven gear when the driving piece is reversely rotated in the toner conveying device of the monochrome printer according to the third embodiment of the present disclosure.

On the other hand, in order to shake off the toner from the conveying screw 72, the driving piece 73 is normally or reversely rotated repeatedly. In that case, during the normal rotation of the driving piece 73, the driving gear 76 is in contact with tooth surfaces on one side of the driven gear 75, as shown in FIG. 7A. On contrast therewith, during the reverse rotation of the driving piece 73, the driving gear 76 is in contact with tooth surfaces on another side of the driven gear 75, as shown in FIG. 7B. A backlash M (backlash: an allowance between the driving gear 76 and the driven gear 75) exists between the driving gear 76 and the driven gear 75. When the rotation direction of the driving gear 73 is changed, the driving gear 76 that has passed through the backlash M comes into contact with the driven gear 75, thereby vibrating the conveying screw 72 in the left and right directions. By adopting such a configuration, the conveying screw 72 may be vibrated in the left and right directions (in the directions of the rotation axis D), using the backlash M.

While the present disclosure has been described with reference to the particular illustrative embodiment, it is not to be restricted by the embodiment. It is to be appreciated that those skilled in the art can change or modify the embodiment without departing from the scope and spirit of the present disclosure.

What is claimed is:

1. A toner conveying device comprising:

a toner containing part configured to contain a toner;

a conveying member configured to rotate around a rotation axis so as to convey the toner in the toner containing part; and a vibration mechanism configured to vibrate the conveying member in directions of the rotation axis, wherein the vibration mechanism includes:

a biasing member configured to bias the conveying member to one side of the directions of the rotation axis; and a pressing member configured to press the conveying member to another side of the directions of the rotation axis against biasing force of the biasing member, the pressing member is arranged outside the toner containing part, and a pressing projection is provided on a surface of the pressing member in the other side of the directions of the rotation axis, the conveying member includes a pressed piece arranged outside the toner containing part, and a pressed projection is provided on a surface of the pressed piece in the one side of the directions of the rotation axis, the pressing projection is configured to press the pressed projection to the other side of the directions of the rotation axis accompanying to a rotation of the conveying member, the pressing projection and the pressed projection are arranged outside the toner containing part.

2. The toner conveying device according to claim 1, wherein a plurality of the pressing projections and a plurality of the pressed projections are provided at intervals of an equal angle.

3. The toner conveying device according to claim 1, wherein the pressing projection includes a pressing guide surface inclined in a direction projecting from the surface of the pressing member in the other side of the directions of the rotation axis toward a lower stream side in a direction of the rotation of the conveying member.

4. The toner conveying device according to claim 1, wherein the pressed projection includes a pressed guide surface inclined in a direction projecting from the surface of the pressured piece in the one side of the directions of the rotation axis toward an upper stream side in a direction of the rotation of the conveying member.

5. The toner conveying device according to claim 1, wherein the vibration mechanism includes:

a driving piece including a driving gear; and a vibration source configured to rotate the driving piece normally or reversely, the conveying member includes a driven piece including a driven gear configured to mesh with the driving gear, and the driving gear and the driven gear are composed of helical gears.

6. The toner conveying device according to claim 1, wherein the conveying member is a conveying screw including:

a screw shaft extending in the directions of the rotation axis; and a spiral fin installed around the screw shaft.

7. An image forming apparatus comprising the toner conveying device according to claim 1.

8. The image forming apparatus according to claim 7, wherein a plurality of the pressing projections and a plurality of the pressed projections are provided at intervals of an equal angle.

9. The image forming apparatus according to claim 7, wherein the pressing projection includes a pressing guide surface inclined in a direction projecting from the surface of the pressing member in the other side of the directions of the rotation axis toward a lower stream side in a direction of the rotation of the conveying member.

10. The image forming apparatus according to claim 7, wherein the pressed projection includes a pressed guide surface inclined in a direction projecting from the surface of the pressured piece in the one side of the directions of the rotation axis toward an upper stream side in a direction of the rotation of the conveying member.

11. The image forming apparatus according to claim 7, wherein the pressing member is configured to rotate around a pressing axis extending in a direction crossing the rotation axis, and a cam part pressing the conveying member to the other side of the directions of the rotation axis accompanying to a rotation of the pressing member is provided on an outer peripheral portion of the pressing member.

12. The image forming apparatus according to claim 7, wherein the vibration mechanism includes:

a driving piece including a driving gear; and a vibration source configured to rotate the driving piece normally or reversely, the conveying member includes a driven piece including a driven gear configured to mesh with the driving gear, and the driving gear and the driven gear are composed of helical gears.

13. A toner conveying device comprising:

a toner containing part configured to contain a toner;

a conveying member configured to rotate around a rotation axis so as to convey the toner in the toner containing part; and a vibration mechanism configured to vibrate the conveying member in directions of the rotation axis, wherein the vibration mechanism includes:

a biasing member configured to bias the conveying member to one side of the directions of the rotation axis; and a pressing member configured to press the conveying member to another side of the directions of the rotation axis against biasing force of the biasing member, and the pressing member is configured to rotate around a pressing axis extending in a direction crossing the rotation axis of the conveying member, and a cam part pressing the conveying member to the other side of the directions of the rotation axis accompanying to a rotation of the pressing member is provided on an outer peripheral portion of the pressing member.

14. The toner conveying device according to claim 13, wherein the cam part includes a bend portion configured to be bent toward an inner diameter side of the pressing member.

15. A toner conveying device comprising:

a toner containing part configured to contain a toner;

a conveying member configured to rotate around a rotation axis so as to convey the toner in the toner containing part;

a vibration mechanism configured to vibrate the conveying member in directions of the rotation axis; and a sealing member interposed between the toner containing part and a portion of the conveying member held within the toner containing part and being compressible in the directions of the rotation axis.

* * * * *